United States Patent [19]

Kulka et al.

[11] 3,943,501

[45] Mar. 9, 1976

[54] PRINTING MACHINE HIGH VOLTAGE POWER SYSTEM AND CIRCUIT

[75] Inventors: Robert A. Kulka, Livingston; Thomas F. Bright, Bergenfield; Thomas P. Bruno, Philipsburg; Charles S. Huffsmith, Metuchen, all of N.J.

[73] Assignee: Wood Industries, Inc., Middlesex, N.J.

[22] Filed: Feb. 7, 1975

[21] Appl. No.: 547,868

[52] U.S. Cl. ..... 340/253 R; 101/349; 317/262 R

[51] Int. Cl.[2] ..... G08B 21/00

[58] Field of Search ..... 340/248 R, 253 R; 317/262 R, 262 AE, 262 A; 101/349, 350

[56] References Cited

UNITED STATES PATENTS

| | | | |
|---|---|---|---|
| 3,011,435 | 12/1961 | Jones et al. | 317/262 R X |
| 3,295,441 | 1/1967 | Garnier | 317/262 R X |
| 3,515,064 | 6/1970 | Vlier | 101/349 |
| 3,828,674 | 8/1974 | Underwood et al. | 101/349 |

*Primary Examiner*—John W. Caldwell
*Assistant Examiner*—Daniel Myer
*Attorney, Agent, or Firm*—David S. Woronoff

[57] ABSTRACT

The high D.C. voltage power supply device for the electrodes of an electrostatic ink mist prevention system in rotary printing machines has a conventional full-wave voltage doubling circuit consisting basically of a transformer, plug-in rectifiers, plug-in capacitors and plug-in bleeder resisters. Additional circuitry mounted on an interchangeable printed circuit board comprising exclusively standard solid state switching elements such as an integrated circuit for producing an output pulse when the line voltage goes through zero voltage, which is utilized for turning the high voltage on and off via an SCR firing circuit in addition to illuminating a pilot light via a triac firing circuit. The D.C. high voltage load current is sensed across a resistor, and a resistor potentiometer is provided for setting the high voltage current turn-off trip point. A timing device is provided for re-energizing the solid state circuitry after a preset time interval. The pilot light starts flashing when the triac is fired from the flashing circuit; but as long as a fault is still present, the system turns off again. This is repeated until the fault is cleared away, whereupon the solid state circuitry re-energizes the system automatically.

10 Claims, 3 Drawing Figures

PRINTING MACHINE HIGH VOLTAGE POWER SYSTEM AND CIRCUIT

BACKGROUND OF THE INVENTION

The invention relates generally to D.C. voltage power supply devices and particularly to a power supply device for high voltage D.C electrodes in an electrostatic system for the prevention of the formation of ink mist in a high speed rotary printing machine.

High voltage D.C. power supply systems are known and in use in similar applications where it is intended to prevent the ambient atmosphere in the printing press room from being polluted by the micro-fine ink mist which is generated by the ink rollers of the printing machine. In one of the best known applications electrodes are installed parallel to the ink rollers of the printing machine and these electrodes are connected to the high voltage D.C. output of the power supply device for electrostatically emitting streams of ionized air against the grounded rollers whereby the micro-fine ink mist particles are prevented from flying off the surface of the rollers and from floating freely in the pressroom atmosphere. In another application of high voltage D.C. for the electrostatic elimination of ink mist, very thin wires are strung parallel of the nips of the ink rollers. These systems and their high voltage D.C. power supply diagrams are shown in the U.S. Pat. Nos. 3,515,064 and 3,011,435. Protecting both the power supply device and the installations in the printing machines against faults or shorts had been provided in the form of fuses and/or electro-mechanical circuit breakers combined with a signal light. Faults can occur in many ways during the operation of the printing machine causing abnormally high currents, such as by electrodes getting dirty, by electrodes being coated with printing ink; by electrodes breaking, arcing or by foreign matter such as paper shreds getting into and between the electrodes and the rollers causing shorts of the high voltage. When such faults occurred, the prior art safety devices turned the power supply off. Since a plurality of other signal lights of all kinds are installed on the printing machines and on the related individual units present in the pressroom, the fault indicating light on the D.C. power supply cabinet of the prior art devices is not always immediately noticed, if at all, resulting in soiling of the machine and in polluting of the air in the pressroom. Another high voltage D.C. supply systems known from the U.S. Pat. No. 3,295,441 provides switching circuits for switching the power supply on after a fault had occurred a certain limited number of "off-on" cycles. No provision has been made in the prior art for alerting effectively the pressroom personnel so that the fault could be corrected.

All known systems comprise electro-mechanical means such as relays, contactors and switches, which are inherently subject to wear, mechanical failures and to a relative delay of action. These prior art systems also do not keep giving efficient alerting signals as long as the fault prevails, and keep probing the fault and re-energizing the system automatically until the fault has been removed, without being in danger of burning out component parts.

The problems which became known by practicing the prior art, concern mainly the elimination of all mechanically movable electrical elements, the lack of an effectful alarming system for alerting the operating personnel about the actual condition of the power system and automatically re-energizing the system after a fault has been cleared away. These problems are solved by the present invention.

This application is copending with its companion case "Printing Machine High Voltage Power System" invented by Huffsmith and assigned to the assignee of the present invention being application Ser. No. 547,870, filed Feb. 7, 1975.

SUMMARY

The invention consists in such novel features, construction arrangements, combinations of parts and improvements as may be shown and described in connection with the device herein disclosed by way of example only and as illustrative of a preferred embodiment. The novelty of the high voltage D.C. power supply device resides in the new combination of per se known elements and in the application of solid state switching means, which are arranged in two main groups. The first group comprises a full-wave voltage doubling D.C. circuit, with a multi-tap power transformer, diode rectifiers, capacitors and bleeder resistors. This construction provides the high voltage of approximately 12,000 D.C. volt for the ink mist prevention electrodes. The second group which is tied in with the first group comprises an interchangeable printed circuit board which has an integrated circuit and certain solid state switching elements and which is arranged for being plugged in as a whole unit. An output pulse is produced by the integrated circuit on the P.C. board, when the line voltage waveform passes through zero.

This zero crossing firing provision assures that the power transformer will be always turned "on" at this zero voltage point. This is utilized for turning the high output voltage on and off by way of an SCR firing circuit to which a pilot light is connected over a triac firing circuit. A zener diode is provided for protecting the Integrated Circuit from being overdriven. An adjustable potentiometer is arranged for pre-setting the overload trip point of the high voltage output, and when an abnormal high current caused by electrode arcing exceeds a preset value, an SCR circuit is turned "off" which de-energizes the power transformer primary winding, whereby the high voltage is automatically turned off. Due to the comprehensive use of solid state switching elements this action takes place within 8 to 16 milliseconds, i.e., within ½ to 1 Hertz. The pilot light flashes at the rate of the flashing circuit $B_1$, $C_8$ and $R_{16}$. The flashing continues as long as the abnormal current overload exists. An adjustable timing device is included in the integrated circuit, which will restore automatically the high voltage by turning the SCR on and stopping the flashing of the pilot light. The timing can be set within the range from 1 to 8 seconds. However if the abnormal high current overload on the high voltage electrode remains, the system is turned off and the pilot light flashes again. The pressroom personnel will be alerted by this kind of signalling and will take action for removing the source of the trouble, such as by cleaning a soiled electrode.

Objects and advantages of the invention will be set forth in part hereafter and in part will be obvious herefrom or may be learned by practicing the invention, the same being realized and attained by means of the instrumentalities and combinations pointed out in the appended claims.

It is an object of the invention to provide an improved high voltage power supply device for an ink mist prevention system in a rotary printing machine.

It is a further object of the invention to provide a high voltage power supply device which comprises exclusively solid state switching elements because of the atmosphere in a printroom is detrimental to the long life of mechanical switches.

Another object of the invention is to provide circuitry means which permits the use of solid state switching and control elements pre-fabricated and integrally mounted on a plug-in printed circuit board.

Furthermore it is an object of the invention to provide the combination with automatically on and off switching elements to control 2 flashing pilot lights indicating the occurrence of an abnormally high current in the electrode system.

Various further and more specific purposes, features and advantages will clearly appear from the detailed description given below taken in connection with the accompanying drawing which forms part of the specification and illustrates merely by way of example one embodiment of the device of the invention.

BRIEF DESCRIPTION OF THE DRAWING

In the following description and in the claims, parts will be identified by specific names for convenience, but such names are intended to be generic in their application to similar parts as the art will permit. Like reference characters denote like parts in the figures of the drawing, in which:

DESCRIPTION OF THE PREFERRED EMBODIMENT

Figure 1:
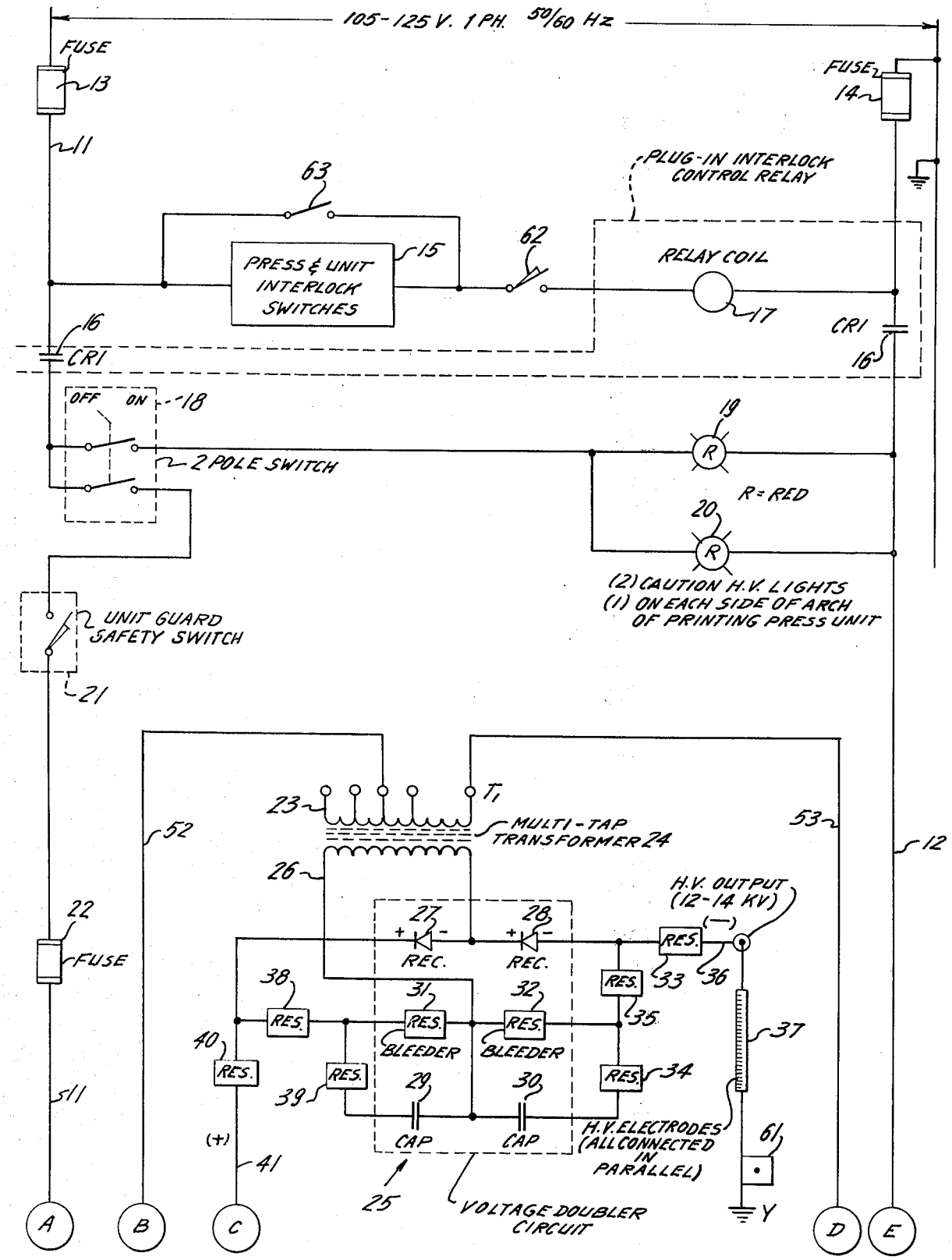
FIG. 1 is the first portion of the line diagram of the D.C. high voltage supply device for a printing ink mist prevention electrode.

Referring now in more detail to the drawing illustrating a preferred embodiment by which the invention may be realized, there is in FIG. 1 illustrating by way of a line diagram the first portion of the device, an A.C. power feed line 11, 12 of standard 105 to 125 volts, single phase. Fuses 13, 14 are provided in line 11, 12 and printing press unit interlock switches 15 are arranged for switching the entire device on when the printing press is set in motion. A plug-in control interlock relay CRI (16) has a relay coil 17 for checking the voltage. When the press is not in use, it is bypassed by a test switch 63. A further manually operated two-pole switch 18 is provided as part of the control station located on each printing press unit. Red caution lights 19, 20 are positioned on each side of the arch of the printing press unit for warning the press operator that the entire ink mist prevention system is in operation. Unit guard switches 21, usually more than one, are provided on the printing press unit guards for interrupting the power line 11, when a guard is open or is taken off. One more fuse 22 is arranged in line 11 for protecting the printing press controls against a fault in the line of the primary winding 23 of the multitap main transformer 24 of the A.C. high voltage circuit. The secondary winding 26 of transformer 24 is connected with the voltage-doubling circuit 25 which comprises the two diode rectifiers 27, 28 the two capacitors 29, 30 and the two bleeder resistors 31, 32. Surge resistors 33, 34, 35 in the negative voltage line 36 leading to the ink mist prevention electrode 37, and surge resistors 38, 39, 40 in the positive voltage line 41 complete circuit 25.

Figure 2:
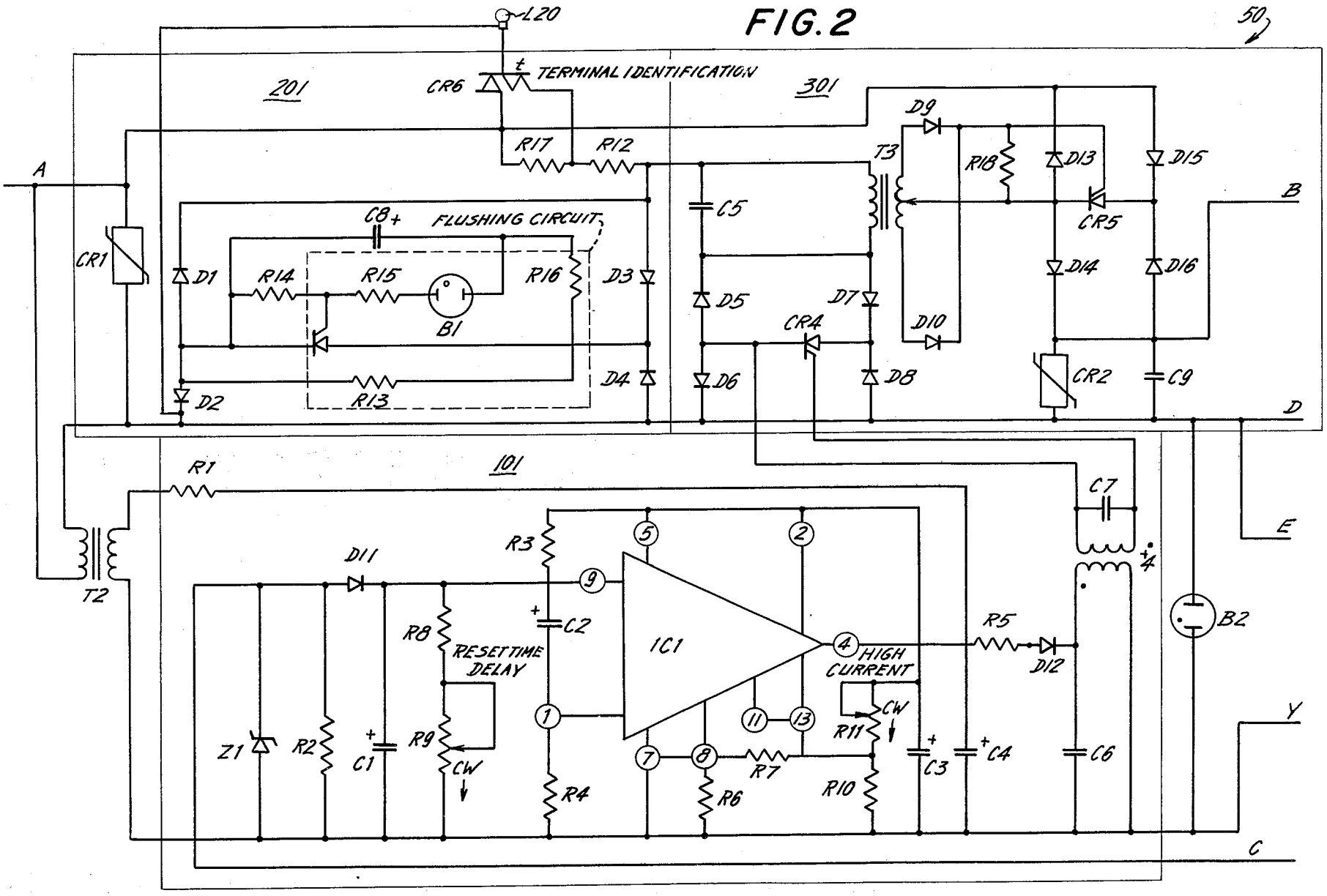
FIG. 2 shows the second portion of the line diagram of the D.C. high voltage supply device, comprising the plug-in printed circuit board.
Figure 3:
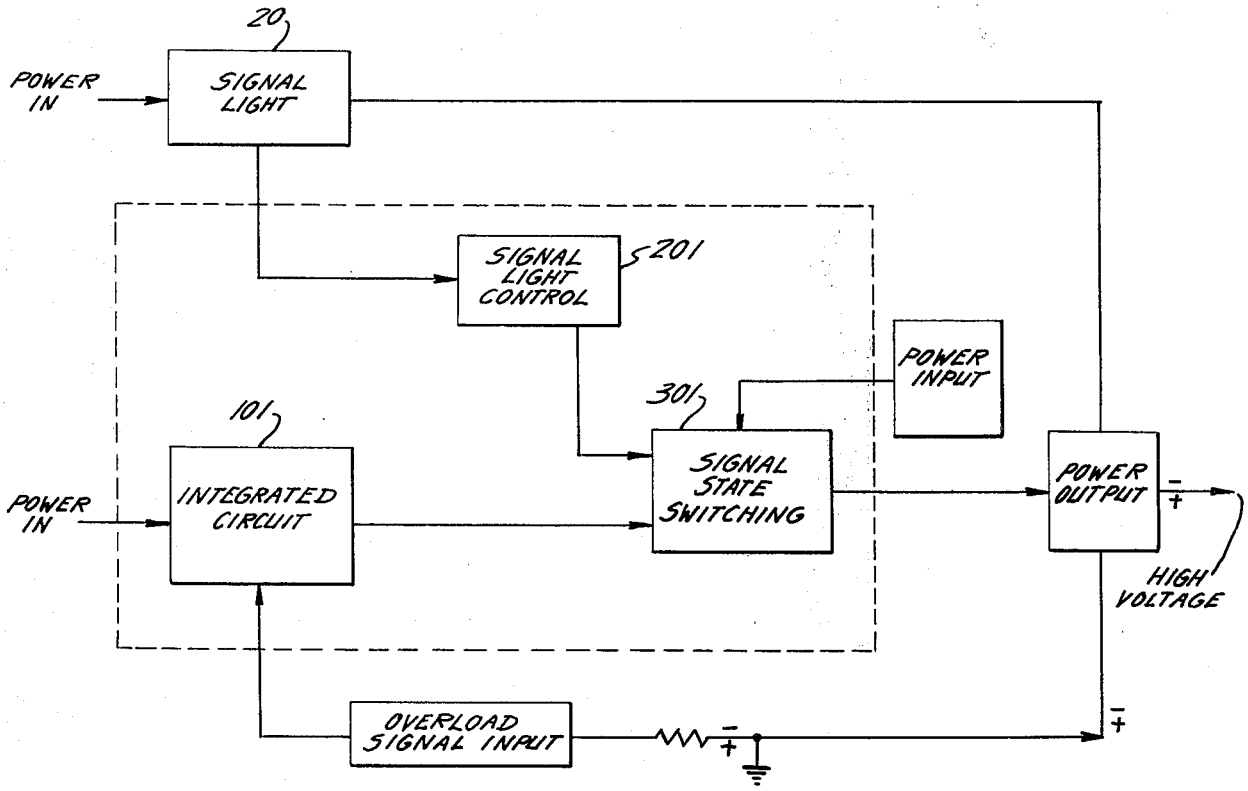
FIG. 3 is a block diagram showing the functional elements on the P.C. board.

The second portion of the line diagram of the device is shown in FIG. 2 illustrating in box form the circuitry of the interchangeable printed circuitry board 50. Terminals marked A, B, C, D, E and Y correspond to the terminals marked A, B, C, D, E and Y of the first portion shown in FIG. 1 of the total diagram.

Basically the printed circuit board has three types of circuits contained on it; A pulse generator circuit 101, a signal light control circuit 201; and a solid state switching circuit 301 for maintaining output voltage on the transformer $T_1$, for rectification by the voltage doubler circuit 25.

IC 1 is an RCA CA 3059 type integrated circuit which has an equivalent circuit shown in the RCA catalog. IC 1 puts out pulses as long as the voltage input does not diminish below a pre-set value controlled by variable resistor R11.

When the overload signal applied to $IC_1$ exceeds the pre-set value set by R11, IC 1 produces no output pulse. The loss of output pulse causes SCR's CR4 and CR5 to stop conducting and no voltage is supplied to transformer $T_1$.

While the overload signal voltage remains low the integrated circuit will put out a pulse every time the line voltage crosses through zero. If the short is removed the SCR's CR4 and CR5 will fire and power will be resupplied to the output transformer $T_1$. If the short is present, CR4 and CR5 will not fire and the high overload voltage will cause IC 1 to stop producing pulses. The SCR Firing Circuit then caused the flashing circuit to oscillate, flashing $L_{20}$. If the "short" is partial and not total as frequently occurs in an ink mist prevention system, the circuitry will cause the voltage doubler output voltage to remain at a high level even though full output voltage is not maintained. Therefore the total system will function to prevent ink mist formation in the presence of the most common types of shorts present in an ink mist prevention device. These most common shorts are the one which occur from the build-up of ink on the emitter heads. Shorts of true zero resistance are quite rare in these systems. Of course, if one occurs the flashing lights will advise the operator to check the emitting system.

The recycling action keeps repeating until the fault is cleared away, but the ink mist prevention system is not simply turned off unnoticed and the initial control elements such as fuses 13, 14 and 22 and interlock switches 15 and two-pole switch 18 are not affected but remain "on". The printing press itself does also not have to be stopped or decelerated until the high voltage is restored after the fault has been cleared away. The exclusive use of solid state switching elements results in a very short action time of 8 to 16 milliseconds corresponding to ½ to 1 Hertz (frequency cycle).

But in order to indicate and to alert the operating personnel, signal lights 19, 20 are provided on the outside of the enclosure of the supply device, which are caused to flash at the pulsing rate of 1 of the pulse generator 101. Signal lights 19, 20 are wired in series with a signal light control circuit 201 consisting of triac, CR6, a plurality of diodes and resistors, neon lamp and a capacitor all wired as shown in FIG. 2. The function of triac CR6 is to cause lights 19, 20 to flash when it is prevented from firing due to the loss of pulses from integrated IC 1 circuit caused by the switching off of the system due to a current overload. The flashing stops when the switching circuit 301 has turned the system on completely again. In order to set a certain high voltage current limit to fix a minimum permissible overload, an adjustable current limit containing a adjustable potentiometer R11, and a capacitor C3 is connected with integrated IC 1.

A monitor jack 61 circuit is provided on the enclosure of the supply device for the insertion of a probe means for a current measuring instrument, such as a millimeter, for testing and checking the high voltage current. The enclosure of the supply device has also a door (not shown in the drawing), and a door switch 62 (FIG. 1) is arranged for interrupting the A.C. power feed for safety purposes, when maintenance or repair work on the device has to be performed.

While the invention has been described and illustrated with respect to a certain preferred example which gives satisfactory results, it will be understood by those skilled in the art after understanding the principle of the invention, that various other changes and modifications may be made without departing from the spirit and scope of the invention, as specified in the appended claims.

We claim:

1. In an ink mist preventing system and circuit for a printing press having a source of electrical power comprising:

an interlock safety switch means;

an output transformer means;

an electrically activated signal means;

a flashing circuit;

an electronic switching means for activating said signal means; and said electronic switching means including an integrated circuit member.

2. The device claimed in claim 1 including further:

a plurality of electronic switching members controlled by the output of said integrated circuit member.

3. The device claimed in claim 2 wherein:

two of said electronic switching members are silicon controlled rectifiers; and another of said electronic switching members is a triac.

4. The device claimed in claim 3 wherein:

said triac member and said flashing circuit controls the flashing of said signal means.

5. The device claimed in claim 4 wherein:

said silicon controlled rectifiers control said output transformer means.

6. The device claimed in claim 5 wherein:

said output transformer means controls said integrated circuit members output.

7. The device claimed in claim 6 including further:

a variable resistor member for regulating the trip point of said integrated circuit member.

8. The device claimed in claim 7 including further:

a third silicon controlled rectifier member for controlling the switching of said triac.

9. The device claimed in claim 8 including further:

resistive means for controlling the cycle time and cycling voltage of said integrated circuit member.

10. The device claimed in claim 9 including further:

conducting means interconnecting said output transformer means and said integrated circuit member.

* * * * *